US009497556B2

(12) United States Patent
Kaltenbacher et al.

(10) Patent No.: US 9,497,556 B2
(45) Date of Patent: Nov. 15, 2016

(54) SOUND TRANSDUCER FOR INSERTION IN AN EAR

(75) Inventors: Dominik Kaltenbacher, Stuttgart (DE); Armin Schäfer, Remchingen (DE); Jonathan Schächtele, Stuttgart (DE); Hans Zenner, Tübingen (DE); Erich Goll, Böblingen (DE); Ernst Dalhoff, Rottenburg (DE); Paul Muralt, La Sarrat (CH); Janine Conde, Yverdon-les-Bains (CH)

(73) Assignee: Fraunhofer-Gesellschaft zur Förderung der angewandten Forschung e.V., München (DE)

( * ) Notice: Subject to any disclaimer, the term of this patent is extended or adjusted under 35 U.S.C. 154(b) by 656 days.

(21) Appl. No.: 13/034,141

(22) Filed: Feb. 24, 2011

(65) Prior Publication Data

US 2012/0053393 A1 Mar. 1, 2012

(30) Foreign Application Priority Data

Feb. 26, 2010 (DE) ..... 10 2010 009 453

(51) Int. Cl.
*H04R 25/00* (2006.01)
*H04R 17/00* (2006.01)

(52) U.S. Cl.
CPC ..... *H04R 25/606* (2013.01); *H04R 17/00* (2013.01); *Y10T 29/42* (2015.01)

(58) Field of Classification Search
CPC ..... F02B 75/34; F28F 2013/008; H01L 41/1136; H01L 41/1138; H02N 2/18; H02N 2/185
USPC ..... 600/25; 29/25.35, 896.21; 181/130; 381/23.1; 73/585; 310/328, 367; 3/25
See application file for complete search history.

(56) References Cited

U.S. PATENT DOCUMENTS

| | | | | |
|---|---|---|---|---|
| 2,386,279 | A * | 10/1945 | Tibbetts | 310/328 |
| 2,540,187 | A | 2/1951 | Cherry, Jr. | |
| 2,900,536 | A | 8/1959 | Palo | |
| 3,114,849 | A | 12/1963 | Poschenrieder | |
| 5,277,694 | A | 1/1994 | Leysieffer et al. | |

(Continued)

FOREIGN PATENT DOCUMENTS

| | | |
|---|---|---|
| AU | 2009202560 | 7/2009 |
| CH | 494513 | 7/1970 |

(Continued)

OTHER PUBLICATIONS

"European Application Serial No. EP11001587, Search Report dated Nov. 24, 2011", 2 pgs.

(Continued)

*Primary Examiner* — Samuel Gilbert
(74) *Attorney, Agent, or Firm* — Schwegman Lundberg & Woessner, P.A.

(57) ABSTRACT

The invention relates to a sound transducer for producing sound vibrations, which can be inserted in an ear and can be used in particular for an implantable hearing aid. The sound transducer has at least one carrier layer and at least one piezoelectric layer, as a result of which a deflection via a bimorph principle is achieved, or a deflection can be detected by picking up a voltage.

22 Claims, 13 Drawing Sheets

(56) References Cited

U.S. PATENT DOCUMENTS

Figure 1:
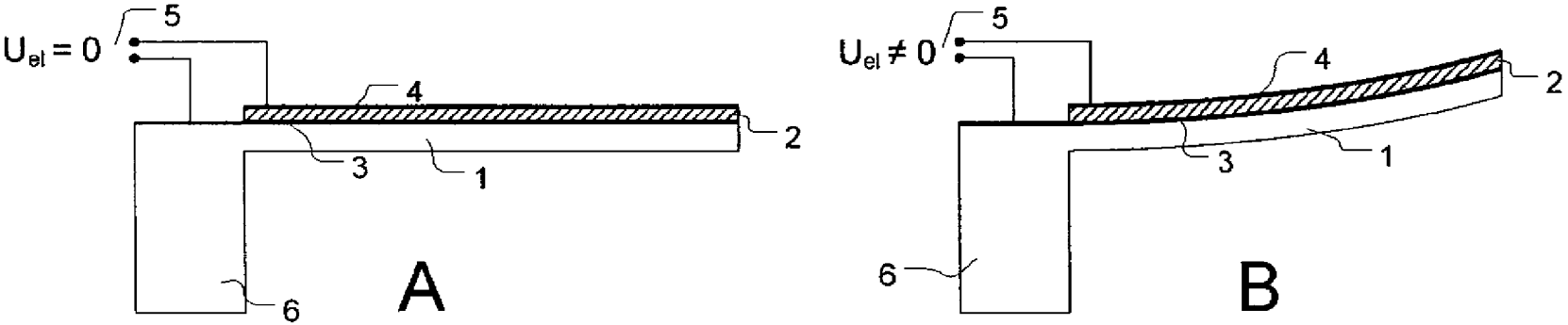

| | | | | |
|---|---|---|---|---|
| 5,631,040 | A * | 5/1997 | Takuchi et al. | 427/100 |
| H1875 | H | 10/2000 | Dames | |
| 6,261,224 | B1 * | 7/2001 | Adams et al. | 600/25 |
| 6,445,265 | B1 * | 9/2002 | Wright | 333/193 |
| 6,629,923 | B2 * | 10/2003 | Leysieffer | 600/25 |
| 7,453,187 | B2 * | 11/2008 | Richards | F02B 75/34 310/339 |
| 2005/0020873 | A1 * | 1/2005 | Berrang et al. | 600/25 |
| 2005/0228214 | A1 | 10/2005 | Schneider et al. | |
| 2006/0087203 | A1 * | 4/2006 | Cho | 310/353 |
| 2008/0231963 | A1 * | 9/2008 | Batchko et al. | 359/665 |
| 2008/0239025 | A1 | 10/2008 | Wang | |
| 2008/0284285 | A1 * | 11/2008 | Sato | 310/323.16 |
| 2009/0146531 | A1 * | 6/2009 | Ruby et al. | 310/324 |

FOREIGN PATENT DOCUMENTS

| | | | |
|---|---|---|---|
| DE | 1200890 | B | 9/1965 |
| DE | 4135408 | A1 | 4/1993 |
| EP | 0499940 | A1 | 8/1992 |
| JP | 61-150499 | A | 7/1986 |
| WO | WO-97/22154 | A1 | 6/1997 |
| WO | WO-00/47138 | A1 | 8/2000 |
| WO | WO 2005/006809 | A1 | 1/2005 |
| WO | WO-2007/023164 | A1 | 3/2007 |

OTHER PUBLICATIONS

Hong, E.-P., et al., "Vibration Modeling and Design of Piezoelectric Floating Mass Transducer for Implantable Middle Ear Hearing Devices", *IEICE Transactions on Fundamentals of Electronics, Communications and Computer Sciences, vol. E90-A, Issue 8*. (Aug. 2007), 1620-1627.

"European Application Serial No. EP11001587, Office Action mailed Feb. 13, 2015", (w/ English Translation), 8 pgs.

"European Application Serial No. EP11001587, Response filed Jun. 25, 2012", (w/ English Translation of Claims), 28 pgs.

* cited by examiner

SOUND TRANSDUCER FOR INSERTION IN AN EAR

CLAIM OF PRIORITY

The present patent application claims the benefit of priority under 35 U.S.C. §119 to German Patent Application No. 10 2010 009 453.6, filed Feb. 26, 2010, the entire contents of which is incorporated herein by reference in its entirety.

The invention relates to a sound transducer for producing sound vibrations, which can be inserted in an ear and can be used in particular for an implantable hearing aid. The sound transducer has at least one carrier layer and at least one piezoelectric layer, as a result of which a deflection via a bimorph principle is achieved, or a deflection can be detected by picking up a voltage.

In the affluent industrial countries, between 10 and 20% of the population are tending increasingly to suffer from a more or less highly pronounced hearing impairment—because of the demographic developments. The majority of patients can be catered for with conventional hearing aids but these systems reach their limits above all with extreme hearing impairment.

Implantable hearing aids (also termed active middle ear implants) are in contrast distinguished by a greater sound amplification potential and better sound quality. However, because of the complex implantation, the risk associated therewith and the high costs, they have been used to date mostly only with fairly young or extremely deaf patients but have proved highly satisfactory there.

The technical problem with hearing aid implants is the coupling of the implanted sound transducer to the auditory system of middle and inner ear. Implants at present thereby produce a mechanical connection to the auditory ossicles. This requires a healthy middle ear for implantation, which excludes from treatment patients with chronic middle ear inflammation and inoperable damage to the ossicle chain.

At present, the predominant number of hearing aids implanted in the middle ear excite the auditory ossicles. For some such solutions, a component is fitted directly on the auditory ossicles, which vibrates and increases the auditory ossicle movement via the direct mechanical coupling. The vibration of the component fitted on the auditory ossicles is generated for example electromagnetically by an iron core which moves between two coils (e.g. AU 2009202560 A2) or by a permanent magnet which vibrates in a magnetic field produced outside the middle ear (e.g. WO 0047138 A1).

Other solutions excite the auditory ossicles via a mechanically directly coupled electromagnetic transducer. The input signal for the excitation of the auditory ossicles is hereby detected either in front of a defective connection point by a mechanically connected sensor or picked up by a microphone which can be implanted or be situated outside the body.

It is problematic with many solutions of prior art that they require a mastoidectomy, in particular in order to supply the sound transducer with electrical energy. Such operations are relatively complex and cannot normally be performed on outpatients. To compound matters, the anatomical spaces which are available for the implantation are exceptionally small and the sound transducer must therefore apply an exceptionally high energy density. In many solutions of prior art, coupling losses occur in addition and the coupling quality is difficult to reproduce. Precisely for this reason, the operation for inserting a hearing aid remains however the preserve of only a few specialists with expensive equipment, for which reason these solutions are expensive and not widely used. In addition, existing actuators have a constructional size which is suitable only in some patients for coupling optimally to the desired anatomical structures, such as for example the round window membrane, whilst a reduction in size of the existing sound transducers would lead to inadequate performance.

OVERVIEW

It is the object of one or more embodiments of the present invention to indicate a sound transducer which can be implanted with low complexity, in particular without a mastoidectomy and, at the same time, achieves high audiological quality. Low variability of the audiological quality is preferably sought after.

The implantable sound transducer according to one or more embodiments of the invention is designed and suitable for the production and/or detection of sound vibrations and has at least one membrane structure. It can usually convert sound to electrical signals and/or electrical signals to sound.

The membrane structure of the sound transducer according to one or more embodiments of the invention is subdivided into at least one, two or several segments in its planar extension by at least one intersection line. Subdivision of the membrane surface means that the total membrane, i.e. both the carrier layer and the piezoelectric layers, and possibly electrode layers, are subdivided by common intersection lines so that the membrane is mechanically decoupled at the intersection line or lines, which means that two regions of the membrane structure which are separated by an intersection line are moveable independently of each other. The subdivision or segmentation of the membrane surface therefore means corresponding segmentation of the carrier layer and corresponding segmentation of the piezoelectric layers and possibly electrode layers.

The segmentation enables a high amplitude of a vibration in the case of a very small constructional size without the power becoming too low as a result of this measure.

As close as possible coupling of a sound transducer to the round window (fenestra cochleae) or oval window (fenestra ovalis or vestibularis) is advantageous for the audiological quality of a hearing aid equipped with the sound transducer, in particular as sound generator. A sound transducer disposed in front of the round or oval window can in addition be implanted by an implanting surgeon via access via the external auditory canal and eardrum in a relatively short time, possibly even purely as an outpatient.

Preferably, the membrane structure is therefore configured such that the sound transducer can be disposed in or in front of a round window or an oval window of an ear such that it covers this window at least partially or completely. In the case of a sound generator, the sound transducer can thereby be disposed with the membrane structure such that vibrations of the membrane structure effect sound vibrations through the round or the oval window. Preferably, the membrane structure is thereby in direct contact with the membrane of the corresponding window.

For particular preference, the sound transducer and the membrane structure are designed such that the sound transducer can be introduced in a niche in front of the oval or round window of an ear, i.e. the round window niche, measured on the average of the population or the majority of the population. An acoustic coupling between the membrane structure and the corresponding window membrane can thereby, on the one hand, be produced by introducing material between the membrane structure and the window membrane, touching both. However, it is preferred if the membrane structure is disposed at the round or oval window such that it contacts the membrane of the corresponding window directly, it being allowed however that layers for passivation or sealing of the membrane structure are disposed between the actual membrane structure and the corresponding window membrane.

There are understood by sound vibrations in the sense of the application, vibrations with frequencies which are perceptible by the human sense of hearing, i.e. vibrations between approx. 2 Hz and 20,000 to 30,000 Hz. The sound vibrations are suitable in addition for exciting sound waves in a medium, in particular air or perilymph.

Advantageously, sound vibrations through the round or oval window can be produced. This means that sound waves can be excited in the inner ear by the sound transducer, which emanate from the corresponding round or oval window. Advantageously, sound waves emanating from the round or oval window can therefore be produced by the membrane structure being made to vibrate in, on or in front of the corresponding window and consequently directly exciting the perilymph, i.e. a liquid medium in the inner ear, for the vibration or exciting a window membrane for the vibration, which then, for its part, excites the perilymph.

According to one or more embodiments of the invention, the membrane structure has at least one carrier layer and at least one piezoelectric layer which has at least one piezoelectric material and is disposed on the carrier layer. The carrier layer and the piezoelectric layer form a bimorph structure and are therefore disposed and configured such that the membrane structure can be made to vibrate by applying a voltage, in particular an alternating voltage, to the piezoelectric layer and/or such that voltages produced by vibration of the membrane can be detected in the piezoelectric layer. The carrier layer and the piezoelectric layer can be disposed for this purpose one upon the other or one against the other with parallel layer planes and should be connected to each other directly or indirectly. The mentioned intersection lines preferably separate all the layers of the membrane structure.

Advantageously, in order to ensure good audiological quality, the membrane structure is configured such that it enables a maximum deflection of 1 to 5 μm, preferably of 5 μm. For this purpose, for example at a frequency ν of 4 kKz, an acoustic flow impedance $Z_F$ of the round window of 32 GΩ and a surface area A of the membrane of the round window of approx. 2 $mm^2$, a driving force of $2\pi\nu Z_F A^2 x = 1.6\ 10^{-2}$ N is required. The average energy corresponds to half the product of maximum force and maximum deflection, i.e. in this example $4 \cdot 10^{-8}$ J, in order to obtain the power. Calculated on a constructional space of e.g. 2 $mm^3$, an energy density of 20 $J/m^3$ is therefore required in this example.

The segments can be designed, in particular with respect to their length, such that the impedance is optimal.

For particular preference, the membrane structure is produced by thin-film technology for this purpose. Thin layers are advantageous since high fields are required in order to produce high energy densities, whilst the voltages which can be applied should however be kept as low as possible because of the biological environment. In a thin-film membrane, the required energy densities can be achieved.

In particular the piezoelectric layers can thereby be produced according to one or more embodiments of the invention by thin-film technology. For this purpose, piezoelectric material with the thickness of the piezoelectric layer is applied for a piezoelectric layer of the membrane structure to be produced. Application can be effected via deposition technologies, such as physical vapour deposition-, chemical vapour deposition sputtering and others. By producing the piezoelectric layers by deposition of piezoelectric material at the desired thickness, significantly thinner piezoelectric layers can be produced than according to the state of the art where ready grown piezoelectric crystals are ground to the thickness of the piezoelectric layer.

Preferably, the piezoelectric layers have a thickness of ≤20 μm, preferably ≤10 μm, particularly preferred ≤5 μm and/or ≥0.2 μm, preferably ≥1 μm, preferably ≥1.5 μm, particularly preferred=2 μm. The electrode layers preferably have a thickness of ≤0.5 μm, preferably ≤0.2 μm, particularly preferred ≤0.1 μm and/or ≥0.02 μm, preferably ≥0.05 μm and particularly preferred ≥0.08 μm.

Thin layers of the sound transducer—both those of the silicon beam structure and those of the piezoelectric layer(s)—ensure that only a small mass is set in motion upon deflection of the beams. The resonance frequency of the vibration system is situated, for the described actuator variants, in the upper range of the frequency band width of human hearing. Therefore uniform excitation of the round window is possible over the entire human frequency range.

Production of the mechanical vibrations of the sound transducer according to one or more embodiments of the invention is thereby based on the principle of elastic deformation of a bending beam, the membrane or segments of the membrane being able to be regarded as bending beam. The piezoelectric layer (piezo layer) can thereby be shortened and/or lengthened by applying the voltage and the electrical field producible as a result. In the material composite comprising carrier layer and piezoelectric layer, mechanical tensions are hereby produced which lead to an upward bending of the beam or of the membrane structure in the case of a shortening piezoelectric layer and to a corresponding downward movement in the case of a lengthening piezoelectric layer. Whether the piezoelectric layer lengthens or shortens depends thereby upon the polarisation direction of the piezoelectric layer and the direction of the voltage applied or electrical field applied.

In the case of a single-layer sound transducer, the described carrier layer can carry a single layer of piezoelectric material. In addition thereto, the electrodes form further components of the layer construction. A bottom electrode can thereby be applied directly or above a barrier layer on the silicon substrate, whereas a top electrode can be situated on the piezoelectric layer. The polarisation direction of the piezoelectric material is preferably perpendicular to the surface of the silicon structure. If now an electrical voltage is applied between top and bottom electrode and if an electrical field is produced, the piezoelectric material shortens or lengthens (according to the sign of the voltage) in the beam longitudinal direction due to the transverse piezoelectric effect, mechanical strains in the layer composite are produced and the beam structure experiences a bending.

It is preferred if the membrane structure has a circular or oval circumference. In particular, it is hereby favourable if the circumference of the membrane structure corresponds to the circumference of the round or oval window of an ear so that the circumferential line of the membrane structure extends parallel to the circumference of the round or oval window when the sound transducer is implanted.

The sound transducer can be placed directly on the membrane of the round window due to a round or slightly oval shape. Since the round window membrane can be regarded as securely clamped on its bony edge and shows no vibration deflection there, the maximum vibration deflections occur in the geometric centre of the membrane. If the sound transducer is now placed in the middle on the round window membrane, the maximum deflections of sound transducer and membrane are superimposed so that good audiological coupling and a high sound amplification potential is achieved by the transducer. Also a polygonal circumference with n corners of the membrane structure with n preferably ≥8 is possible.

In particular in the case of a circular circumference, but also in other shapes, of the membrane structure, it is further preferred if the intersection lines which subdivide the membrane surface into segments extend radially from one edge of the membrane structure in the direction of a centre of the membrane. The intersection lines need not hereby start immediately at the edge and extend up to the centre, it is also adequate if the intersection lines extend from the vicinity of the edge up to the vicinity of the centre.

If however the intersection lines do not reach the centre, a free region should be present in the centre in which the intersection lines end so that the mechanical decoupling of the segments is ensured at that end orientated towards the centre.

The segments can hereby be configured such that they are shaped like a piece of cake, i.e. have two edges extending at an angle relative to each other as side edges and also have an outer edge which extends at the circumference of the membrane structure parallel to this circumference. At the other end of the side edges, opposite the outer edge, the segments can taper towards each other or be cut such that a free region is produced around the centre. The segments can then be disposed securely at the edge of the membrane structure on the outer edge and be independent of each other on the side edges and possibly at that edge orientated towards the centre so that they can vibrate freely around the outer edge. The greatest deflection will hereby occur normally at that end of the segment orientated towards the centre. Preferably, the number of segments is ≥8.

The intersection lines can hereby extend radially straight so that the segments have straight radial edges.

It is however also possible that the radially extending intersection lines extend in a curve so that segments with non-straight radially extending edges are produced. In particular, segments which extend in the radial direction in an arcuate, undulating shape or along a zigzag line can be formed as a result. Numerous other geometries are conceivable.

In an alternative embodiment of the invention, the membrane structure can be structured spirally by at least one intersection line. The at least one intersection line thereby extends such that at least one spiral segment is produced, which is preferably wound around a centre of the membrane structure. It is also possible to provide a plurality of intersection lines which subdivide the membrane structure such that two or more spiral segments which are wound advantageously respectively around the centre of the membrane structure and extend for particular preference one into the other are produced.

In order to make the membrane structure vibrate and/or in order to pick up a voltage on the piezoelectric layer, at least one first and at least one second electrode layer can be disposed on the membrane structure, the at least one piezoelectric layer being disposed between the first and the second electrode layer. The electrode layers hereby cover preferably the piezoelectric layer and are disposed at or on the piezoelectric layer with parallel layer planes. Preferably, the first or second electrode layer is disposed between the carrier layer and the piezoelectric layer so that the piezoelectric layer is disposed on the carrier layer above one of the electrode layers. For particular preference, the piezoelectric layer and the electrode layers cover each other completely.

The use of segment structures, in comparison with an unstructured membrane, allows higher deflection since the beam elements, wherever they are separated by the intersection lines, can be shaped freely, e.g. in the centre of the disc, and hence experience a constant bending in only one direction. The deformation of a continuous membrane is in contrast characterised by a change in direction of the curvature, which leads to lower deflections.

In one embodiment, the membrane structure has a plurality of piezoelectric layers which are disposed one upon the other with parallel surfaces, an electrode layer being disposed between respectively two adjacent piezoelectric layers. Therefore respectively one electrode layer and one piezoelectric layer are disposed alternately on the carrier layer. Electrode layers and piezoelectric layers can be disposed directly one upon the other, connected to each other, or one upon the other above one or more intermediate layers. With this embodiment, vibrations with a particularly high power or performance can be produced and vibrations can be detected particularly exactly.

In the case of this transducer modification, electrodes with a different electrical potential alternate therefore in the layer construction with piezoelectric layers. On the silicon structure there follows firstly a bottom electrode, thereupon a first piezoelectric layer, an electrode with opposite potential, a second piezoelectric layer, an electrode with the potential of the bottom electrode etc.

The polarisation direction of the individual piezoelectric layers can, as in the case of a single-layer transducer, be situated perpendicular to the surface of the membrane structure, however it points in the opposite direction for alternating piezoelectric layers. The electrical field which builds up between the electrodes of opposite potential and the polarisation direction alternating for the individual piezoelectric layers ensures a common change in length of the total layer construction, which in turn causes bending of the silicon structure.

Advantageously, the electrode layers are designed or contacted such that respectively two adjacent electrode layers can be supplied with a charge of a different polarity. As a result, an electrical field can be produced in the piezoelectric layers, which field extends respectively from one electrode layer towards the adjacent electrode layer. In this way, the piezoelectric layers can be penetrated particularly uniformly by electrical fields. In the case of a vibration detection, preferably different signs of a voltage produced on the piezoelectric layer can be picked up respectively by adjacent electrode layers.

In a further advantageous embodiment of the present invention, at least two strip-shaped, i.e. oblong, electrodes which form an electrode pair can be disposed on the surface of the at least one piezoelectric layer or on the surface of the carrier layer such that they extend parallel to the corresponding surface and preferably also extend parallel to each other. The two electrodes of one electrode pair can be supplied respectively with a charge of a different polarity so that an electrical field is formed between the electrodes of an electrode pair, which field penetrates the piezoelectric layer at least in regions. If a plurality of electrode pairs is provided, then an electrical field can also be formed between electrodes of a different polarity of adjacent electrode pairs, which electrical field penetrates the piezoelectric layer. In the case of a vibration detection, different signs of the voltage below can be contacted by respectively one electrode of the electrode pair.

The strip conductor structures of the strip-shaped electrodes can preferably have a rectangular cross-section.

It is particularly advantageous if a large number of electrode pairs with respectively two electrodes which can be supplied with a different polarity are disposed such that the electrodes of the large number of electrode pairs extend parallel to each other. The electrode pairs should thereby be disposed in addition such that respectively two adjacently extending electrodes can be supplied with a charge of a different polarity. In this way, an electrical field penetrating the piezoelectric layer is formed between respectively two adjacent electrodes. As described here, in the case where a large number of electrode pairs is provided, a large number of electrodes is therefore present on a surface of the piezoelectric layer or of the carrier layer, which electrodes can extend parallel to each other and can be disposed adjacently with alternating polarity.

The polarity of the piezoelectric material in this case is not homogeneously distributed over the entire piezoelectric layer, rather the polarisation direction extends in the shape of field lines from the negative to the positive electrode. If, during operation of the transducer, the comb-shaped electrodes are supplied with alternating electrical potential, an electrical field is formed along the polarisation direction of the piezoelectric material, along which field the piezoelectric material expands or shortens. As a result, the entire piezoelectric layer lengthens or shortens in the beam longitudinal direction, which leads to a downward bending or upward bending of the silicon structure.

It is particularly advantageous if the electrodes extend hereby in addition parallel to the edge of the membrane structure. If therefore the membrane structure is circular, then the electrodes preferably form concentric circles around the centre of the membrane structure. Correspondingly, the electrodes preferably also have an oval configuration in the case of an oval membrane structure. The electrodes can extend respectively along the entire circumference parallel to the circumference of the membrane structure or only on a part of the circumference so that they have for example the shape of circumferential segments.

Strip-shaped electrodes can be contacted particularly advantageously via common conductors, a plurality of electrodes being contacted by a common conductor. Thus a plurality of electrodes of one polarity can be connected to at least one first conductor and electrodes of the other polarity to at least one second conductor. In order that the electrodes of a different polarity are disposed alternately, the electrodes of a different polarity assigned to the various conductors can engage one in the other in the shape of a comb. The common conductors can hereby intersect the electrodes of the polarity corresponding to them and extend for example in the case of circular electrodes particularly preferably radially.

Also in the case of a strip-shaped embodiment of the electrodes, the membrane structure can have a multilayer design. It is hereby possible in turn, on the one hand, that a plurality of piezoelectric layers are disposed one upon the other, strip-shaped electrodes then being able to extend between respectively two adjacent piezoelectric layers. The arrangement of the electrodes hereby corresponds to the above-described arrangement on the surface of a piezoelectric layer. However, it is also possible that the membrane structure has at least one piezoelectric layer which is penetrated by strip-shaped electrodes or electrode pairs in one or more planes. In this case, the electrodes of the electrode pairs extend in the interior of the corresponding piezoelectric layer. Various possibilities of the arrangement also correspond here to those of the above-mentioned arrangement on the surface of the piezoelectric layer.

This variant of the sound transducer, compared with the preceding solution, has a thicker piezoelectric layer which can be penetrated by a plurality of layers of comb-shaped electrodes. The polarisation in the piezoelectric material in turn extends in the shape of field lines from the negative to the positive strip conductor electrodes. When a voltage is applied, an electrical field is formed along the polarisation direction and leads to expansion or shortening of the piezoelectric material along the field lines and to a downward bending or upward bending of the beam structure.

In the case of spiral segments, strip-shaped electrodes can be disposed along the longitudinal direction of the segments. Preferably, an electrode pair suffices here.

Since the sound transducer is being used in a biological environment, it is advantageous if the voltage with which the electrodes are supplied is less than 3 volts, preferably less than 2 volts, particularly preferred less than 1.3 volts. Alternatively or additionally, it is also possible to encapsulate the electrodes to be liquid-impermeable and/or electrically insulating so that they do not come in contact with a liquid possibly surrounding the sound transducer.

Such a sealed encapsulation will have however such a high acoustic impedance that significant audiological losses will have to be taken into account.

Since the piezoelectric effect in the observed range is proportional to the strength of the electrical field which penetrates the material, such high fields can be produced by using very thin piezoelectric layers at a very small spacing of the electrodes (the electrical field is calculated, in the homogeneous case, as quotient of voltage applied and spacing of the electrodes) that the piezoelectric effect suffices to achieve the vibration deflections and forces required for excitation of the round window.

The carrier layer can comprise silicon or consist thereof. There are possible as piezoelectric materials, inter alia $PbZr_xTi_{1-x}O_3$ with preferably $0.45<x<0.59$, particularly preferred with dopings of for example La, Mg, Nb, Ta, Sr and the like, preferably with concentrations between 0.1 and 10%. Also further solid solutions with $PbTiO_3$, such as for example $Pb(Mg_{1/3}, Nb_{2/3})O_3$, $Pb(Sn_{1/3}Nb_{2/3})O_3$, are possible. Possible materials are also lead-free materials which contain $KNbO_3$, $NaNbO_3$, dopings with Li, Ta, etc., Bi-containing piezoelectric layers, Aurivilius phases with Ti, Ta, Nb, furthermore also perovskite phases, such as $BiFe_3$. Also standard thin-film materials, such as AlN and ZnO are possible.

Silicon as carrier material for the piezoelectric layers enables the production of the disc-shaped structures and bending beams in the shape of a piece of cake by the structuring technologies of microsystems technology. Known and tested coating and etching methods can be used for the production of beams, electrodes and piezoelectric layer, e.g. sol-gel technologies, sputtering methods, chemical etching, ion etching etc. Furthermore, the methods of microsystems technology allow parallelisation of the manufacturing process; a large number of sound transducers can be produced from one silicon wafer in one production stage. This enables economical production.

The at least one piezoelectric layer preferably has a thickness of ≤20 μm, preferably ≤10 μm, particularly preferred ≤5 μm and/or ≥0.2 μm, preferably ≥1 μm, preferably ≥1.5 μm, particularly preferred=2 μm. The electrode layers respectively preferably have a thickness of ≤0.5 μm preferably ≤0.2 μm, particularly preferred ≤0.1 μm and/or ≥0.02 μm preferably ≥0.05 μm, particularly preferred ≥0.08 μm. A diameter of the membrane structure is preferably ≤4 mm, preferably ≤3 mm, particularly preferred ≤2 mm and/or ≥0.2 mm, preferably ≥0.5 mm, preferably ≥1 mm, particularly preferred=1.5 mm and particularly preferably chosen such that the sound transducer can be disposed suitably in front of the round or oval window of an ear. The sound transducer can preferably be disposed in the round window niche of an ear, the dimensions thereof being able to be understood as that of the majority or the average of the population in the area of validity of the present document.

The sound transducer according to one or more embodiments of the invention can be coupled directly by direct application of the membrane surface on a membrane of the round or oval window. Since the maximum vibration deflection of the transducer in the geometric centre of the disc is superimposed with the maximum vibration of the membrane in the centre of the round window, good audiological coupling with a high sound amplification potential is possible.

According to one or more embodiments of the invention, the sound transducer can also have a plurality of membrane structures, as described above. These membrane structures are thereby structured similarly and are disposed one above the other parallel to each other such that the same segments of the structure or the intersection lines of the membrane structures are situated one above the other. The same segments are then coupled to each other such that a deflection and/or force exertion of one of the segments is transmitted to the adjacent segments. The membrane structures can thereby be disposed one above the other such that, when a voltage of a given polarity is applied to the sound transducer, all the segments are deflected in the same direction. The membrane structures are here identically orientated. In this case, a total force which is higher than that of an individual membrane structure can be produced. It is also possible to dispose the membrane structures one upon the other such that adjacent membrane structures respectively are orientated the other way round so that, when a voltage of a given polarity is applied, adjacent membrane structures respectively deflect in a different direction. In this case, a total deflection which is greater than that of an individual membrane structure can be achieved.

The embodiments of the invention can be adapted specially to the requirements of an implantable hearing aid with an audiological excitation of the round or oval window in the middle ear. The sound transducer is preferably a sound generator. It is also possible to equip standard hearing aids, hearing aids which sit directly on the eardrum, or other miniature loudspeakers, such as for example in headphones, with the sound transducer according to the invention. The sound transducer can be used in addition as a sensor and makes it possible to generate an electrical signal from a sound signal. The sound transducer can therefore also be used as a microphone.

The invention is intended to be explained subsequently with reference to some Figures by way of example. The same reference numbers thereby correspond to the same or corresponding features. The features shown in the examples can also be produced according to one or more embodiments of the invention independently of the concrete example and in any combination with other described features.

There are shown

Figure 2B:
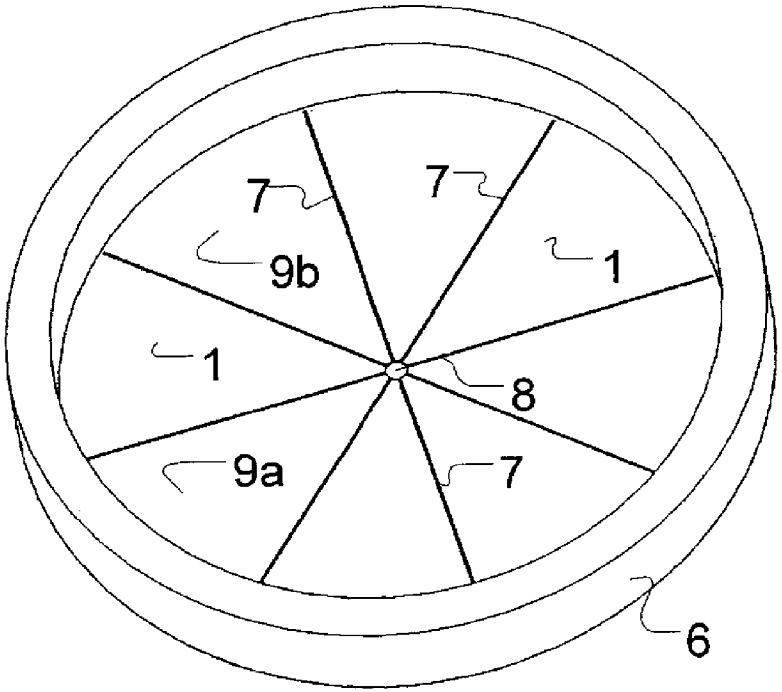
Figure 2A:
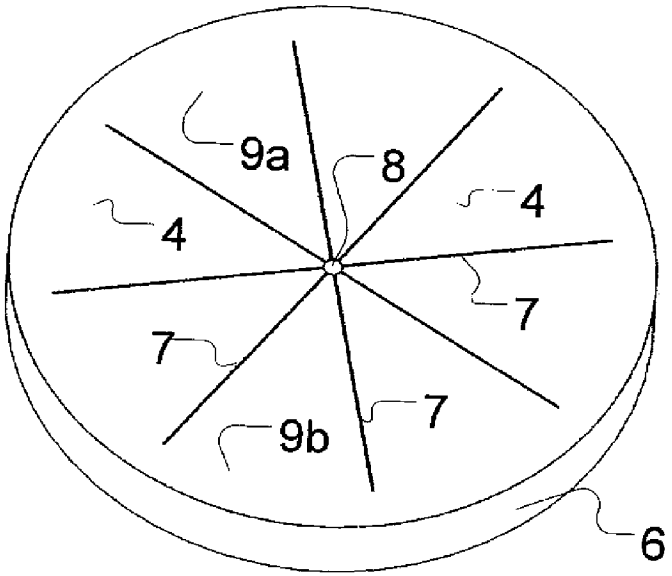
Figure 2C:
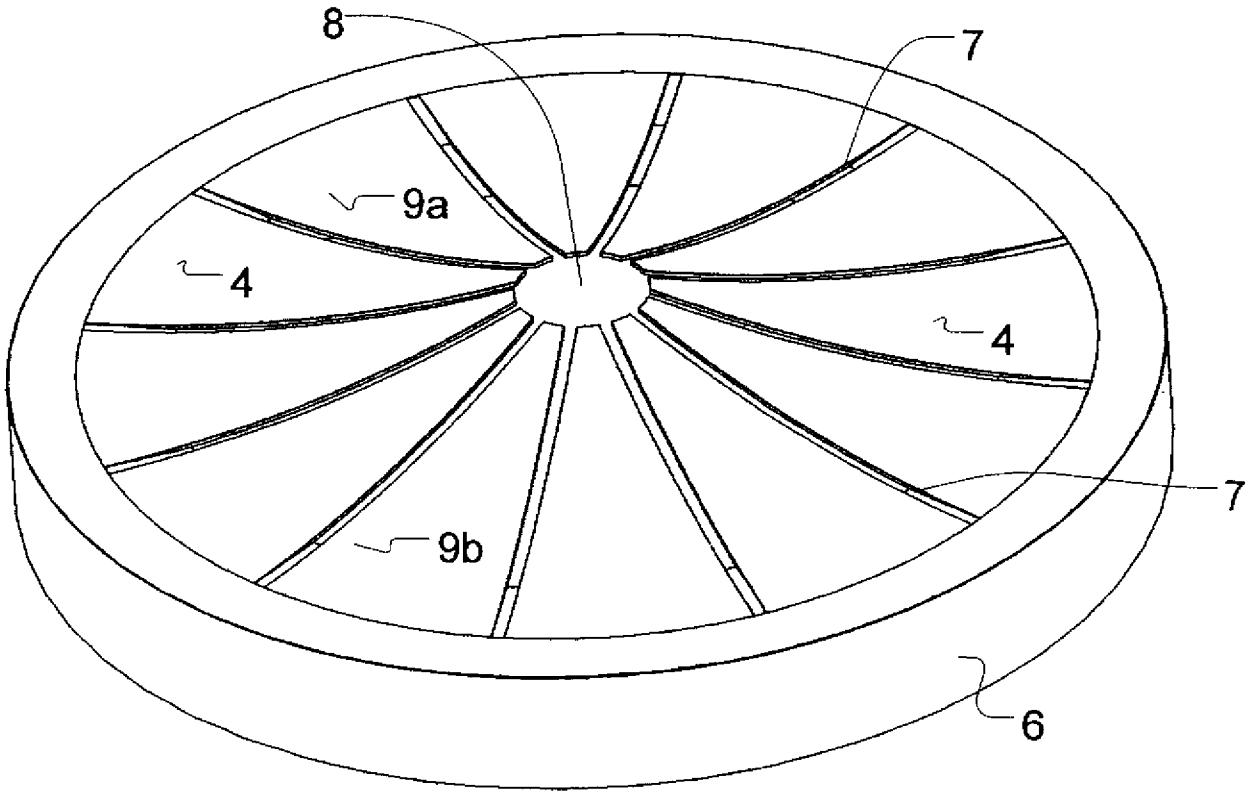
Figure 3:
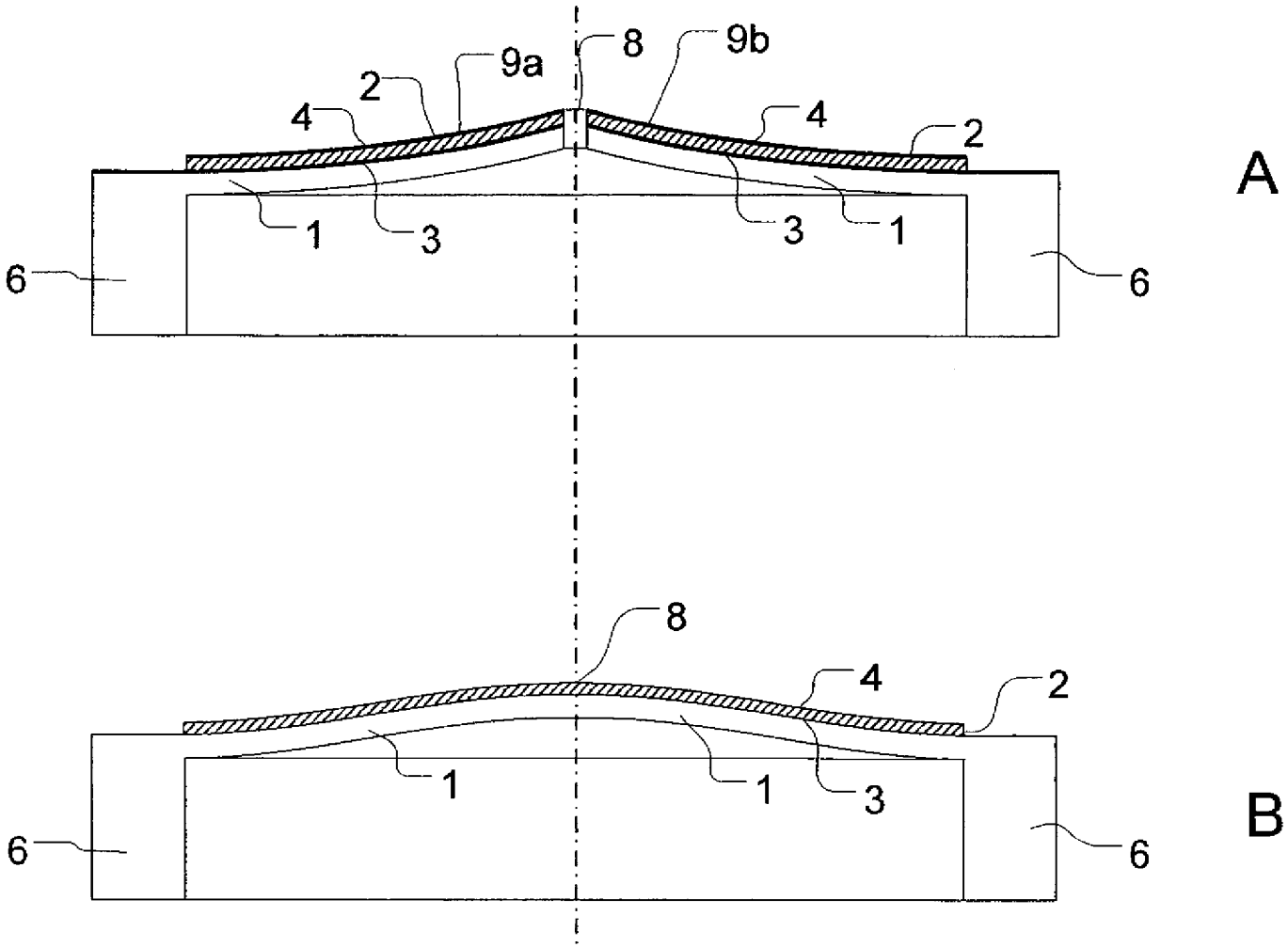
Figure 4:
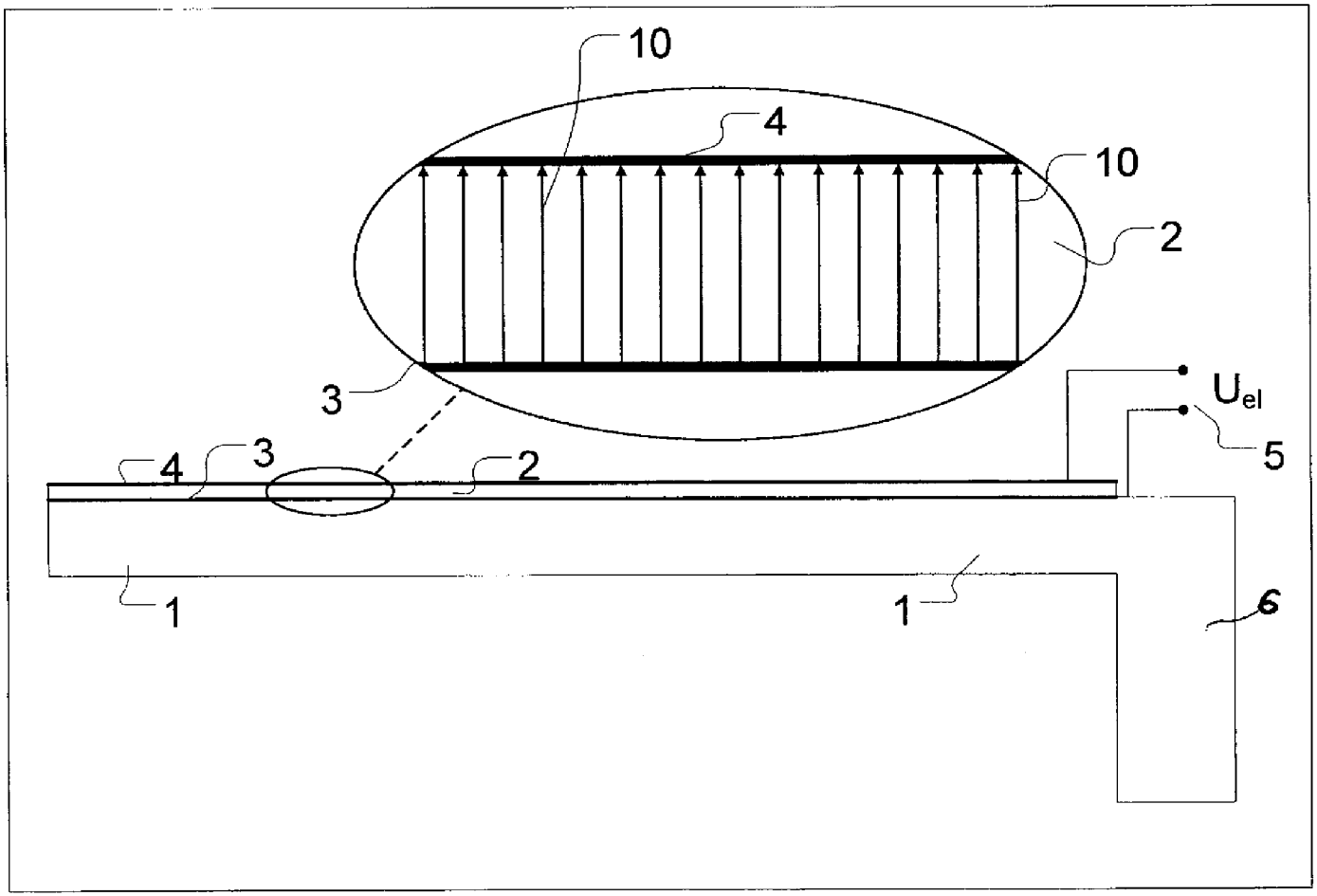
Figure 5:
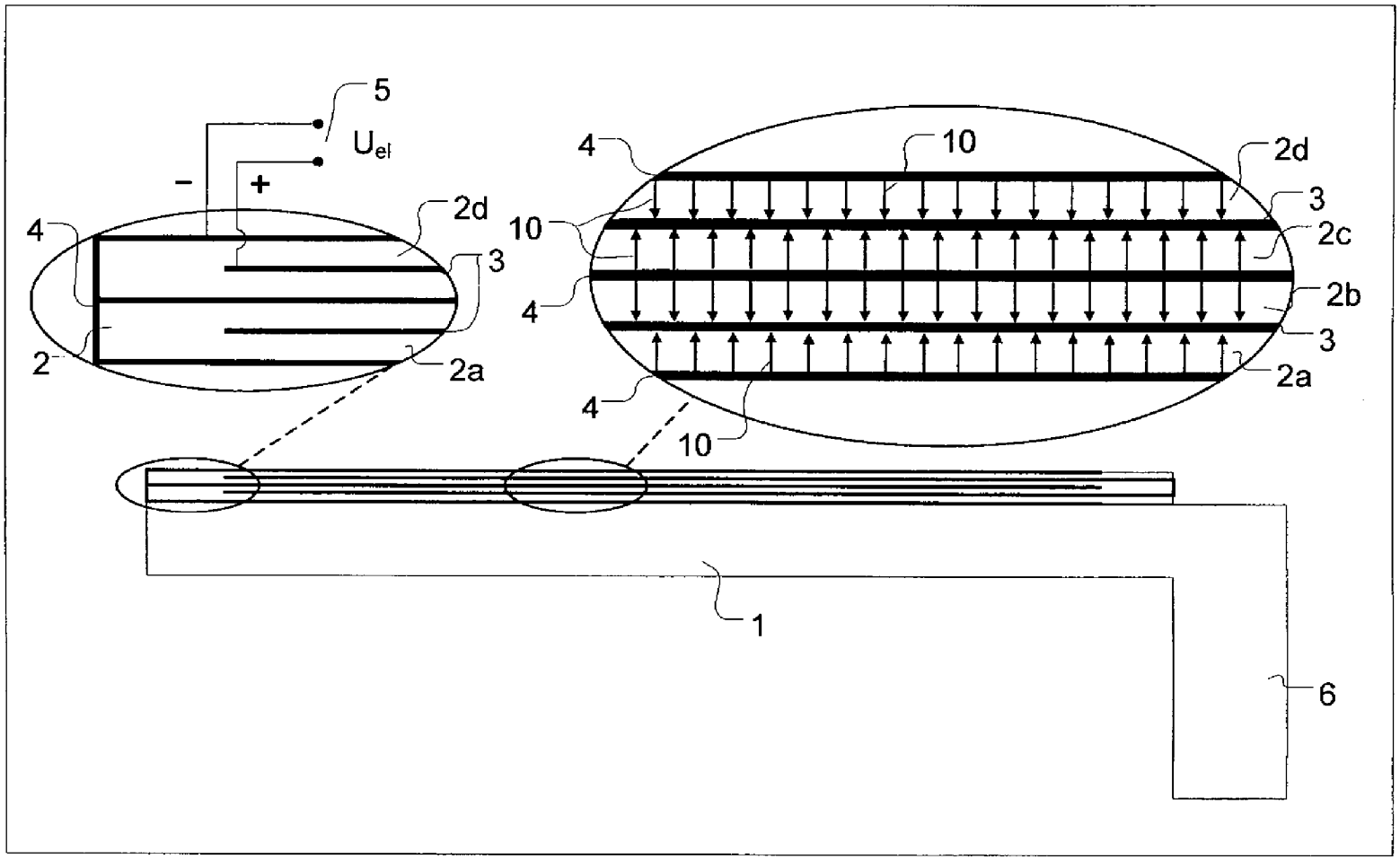
Figure 6:
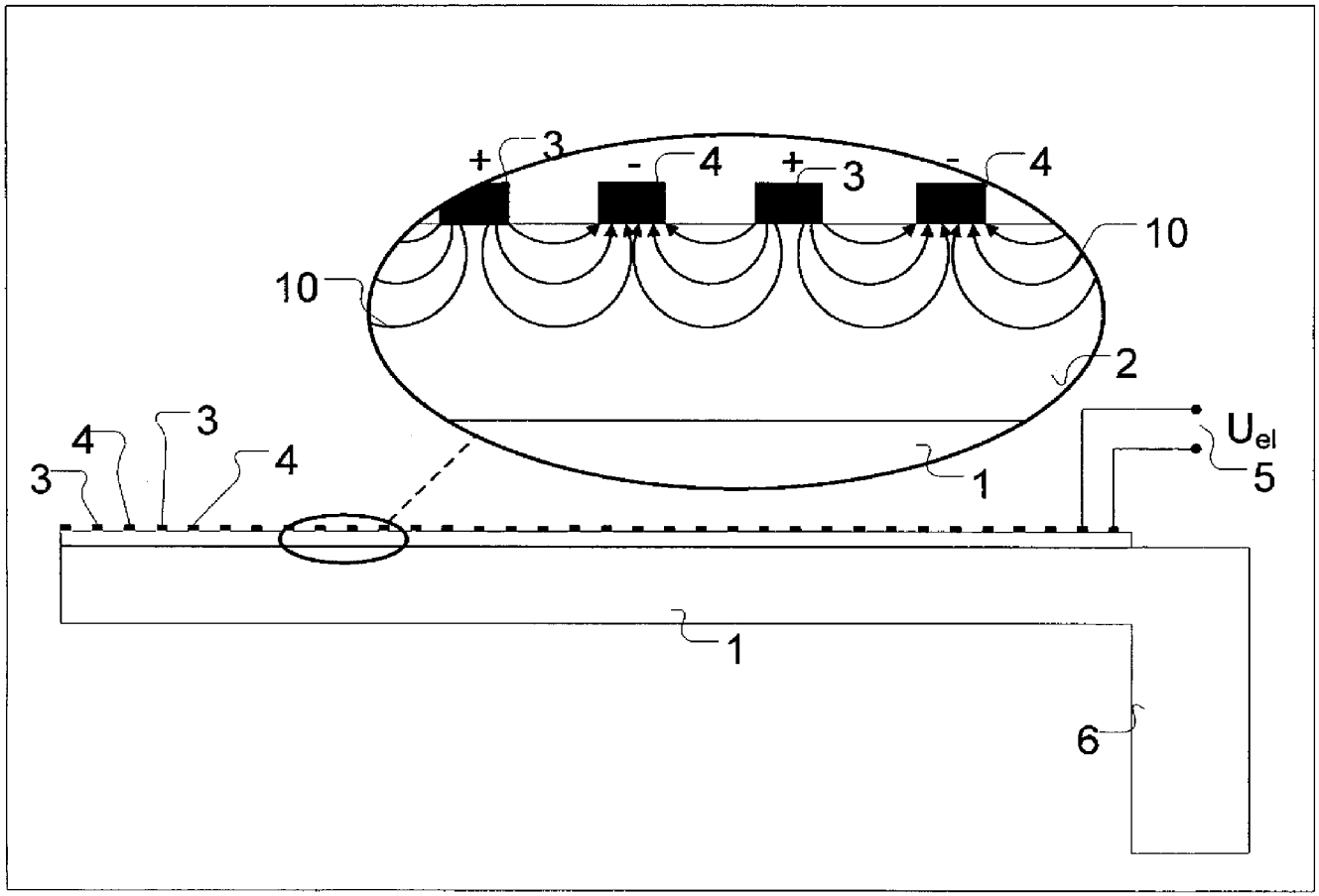
Figure 7:
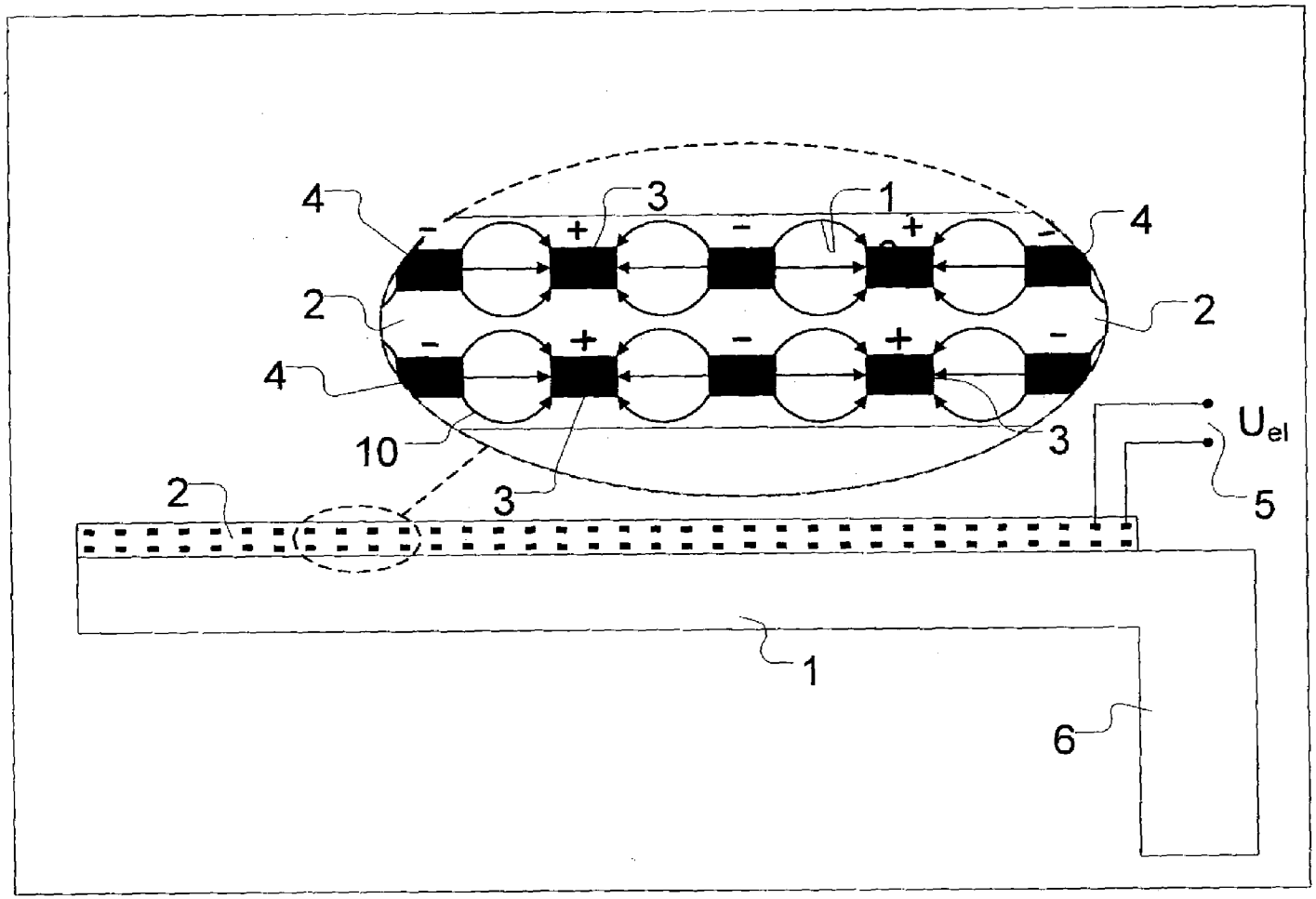
Figure 8A:
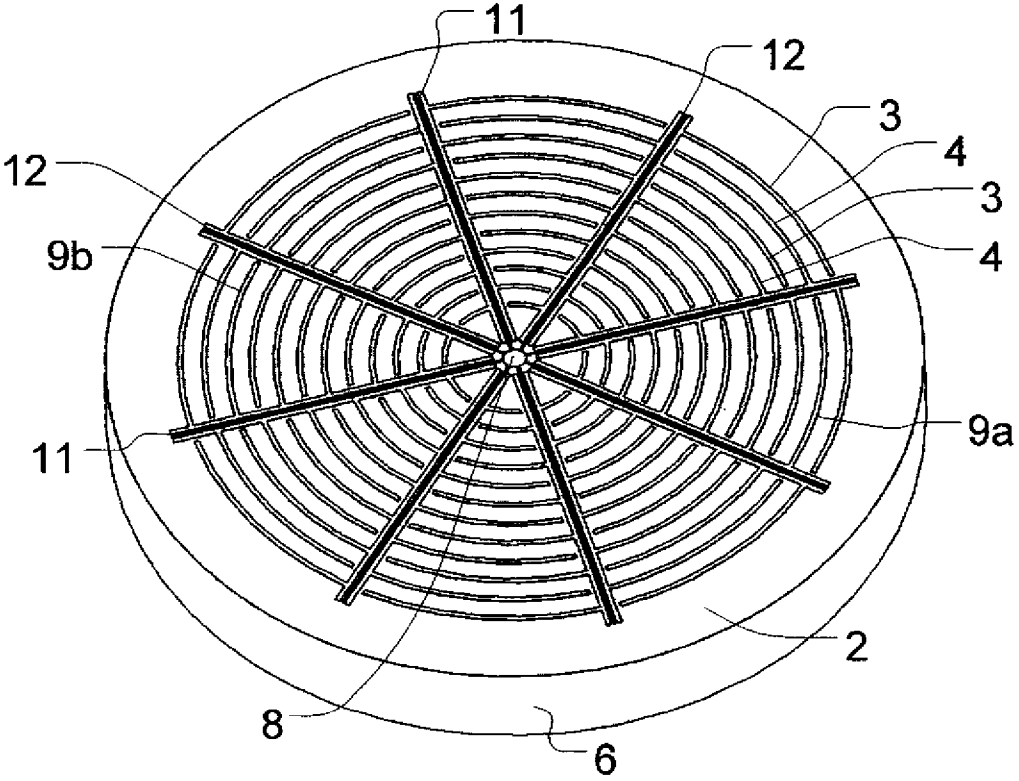
Figure 8B:
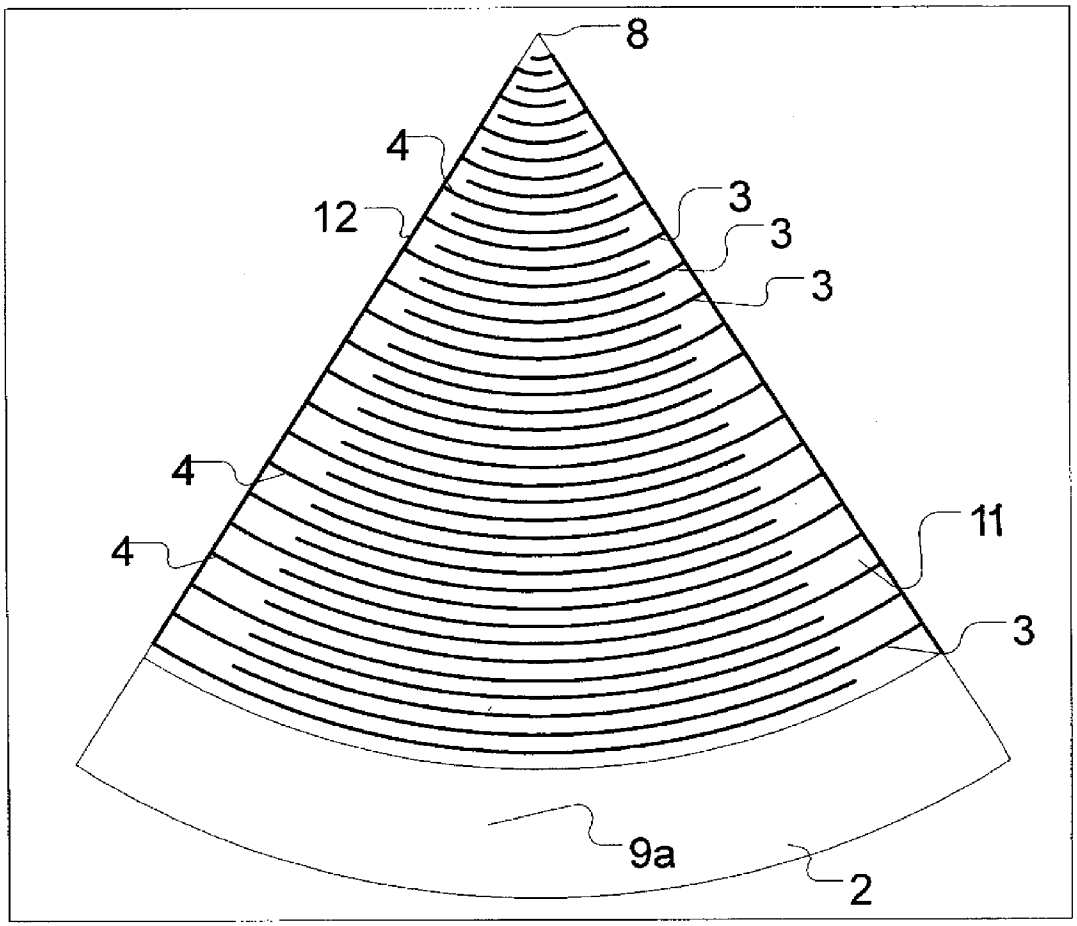
Figure 9:
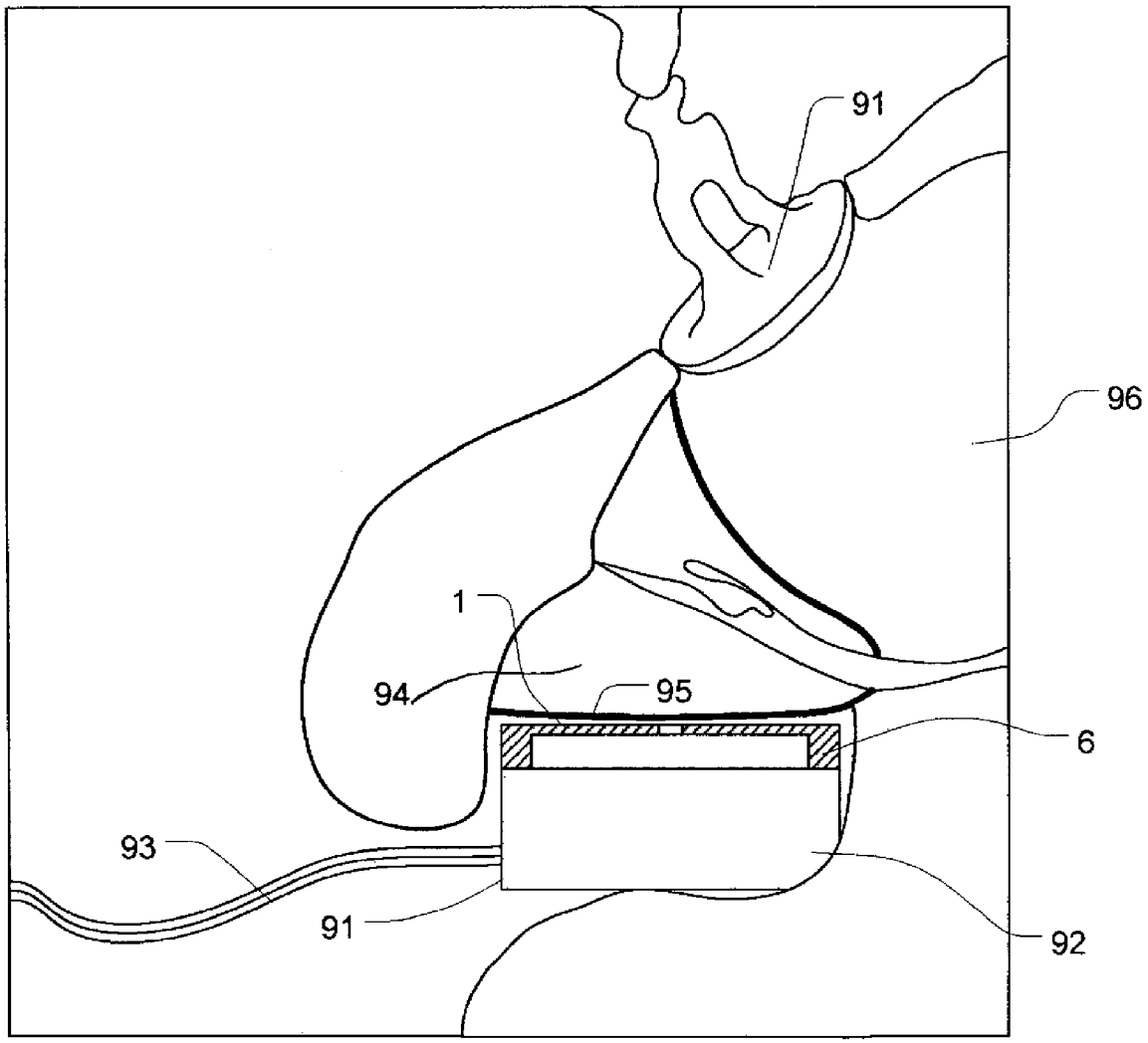
Figure 10:
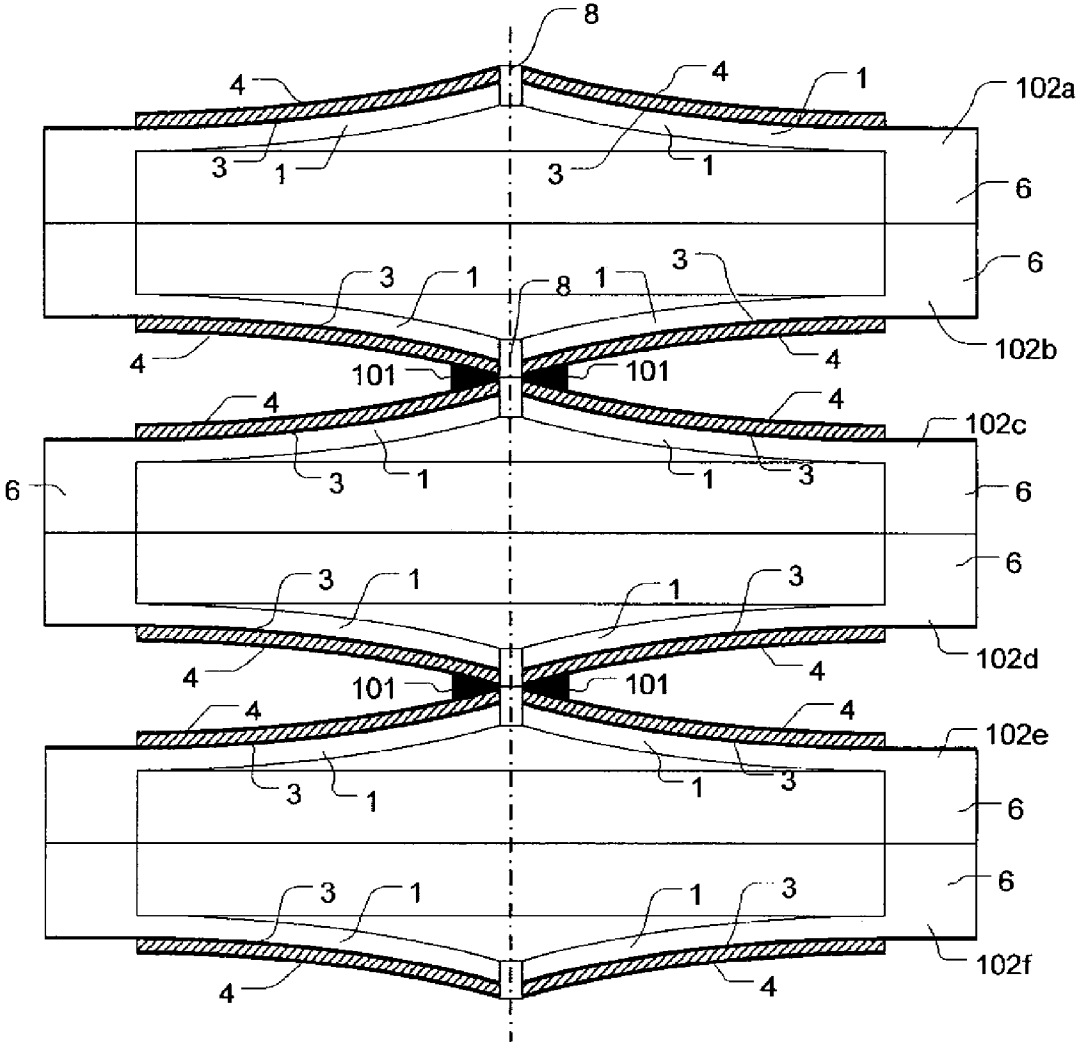
Figure 11:
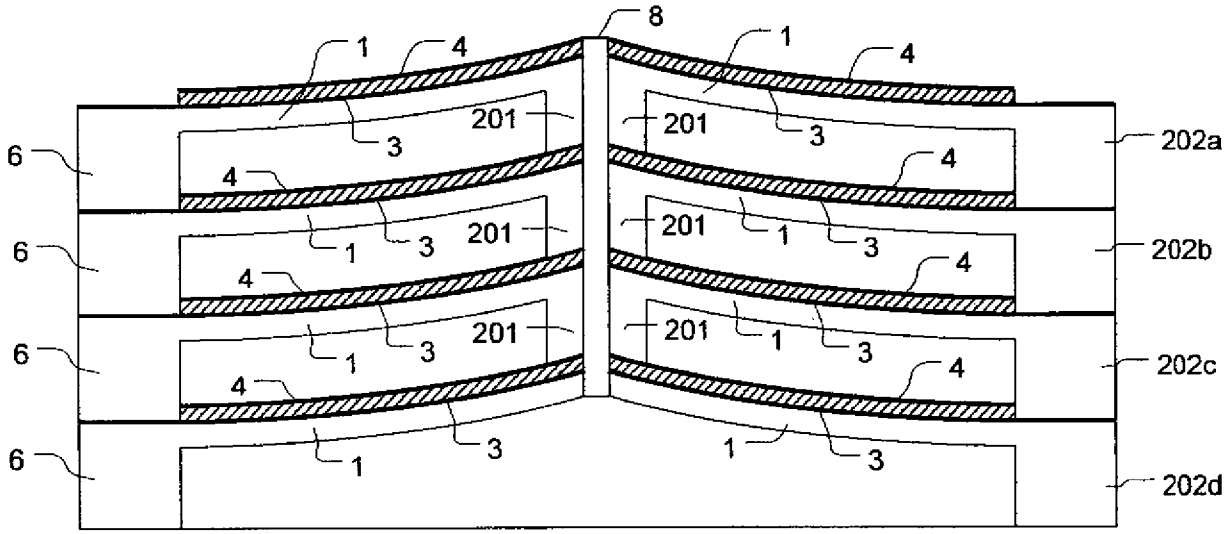

FIG. 1 the principle of deflection of a membrane structure according to one or more embodiments of the invention, FIG. 2 a membrane structure according to the invention which is circular and subdivided into segments in the shape of a piece of cake, FIG. 3 a section through membrane structures according to one or more embodiments of the invention, FIG. 4 a section through a sound transducer according to one or more embodiments of the invention having a piezoelectric layer disposed between two electrode layers, FIG. 5 a section through a sound transducer according to one or more embodiments of the invention having a plurality of piezoelectric layers, FIG. 6 a section through a sound transducer according to one or more embodiments of the invention having strip-shaped electrodes disposed on the piezoelectric layer, FIG. 7 a section through a sound transducer according to one or more embodiments of the invention, having strip-shaped electrodes penetrating a piezoelectric layer, FIG. 8 a plan view on a sound transducer according to one or more embodiments of the invention having strip-shaped electrodes, FIG. 9 an arrangement by way of example of a sound transducer according to one or more embodiments of the invention in an ear, FIG. 10 a sound transducer according to the invention having a plurality of membrane structures which are disposed one above the other and enable a high amplitude, and FIG. 11 a sound transducer according to one or more embodiments of the invention having a plurality of membrane structures which are disposed one upon the other, which sound transducer enables deflection with high power.

DESCRIPTION

FIG. 1 shows the construction in principle of a sound transducer according to one or more embodiments of the invention for the production and/or detection of sound vibrations, which sound transducer can be inserted in an ear. In the illustrated example, a membrane structure is disposed on a carrier layer 1, for example a silicon layer 1, which membrane structure has a piezoelectric layer 2 and also two electrode layers 3 and 4. The carrier layer 1 (elastic layer 1) can thereby be for example approx. one to two times as thick as the piezoelectric layer. Between the electrode layers 3 and 4, a voltage can be applied by means of a voltage source 5 or a voltage can be detected by means of a suitable detector. In the illustrated example, firstly one of the electrode layers 3 is disposed on the carrier layer 1, on which electrode layer the piezoelectric layer 2 is then disposed. On that side of the piezoelectric layer 2 situated opposite the side contacting the electrode layer 3, the second electrode layer 4 is disposed. By applying a voltage by means of the voltage source 5, the electrode layers 3 and 4 can be charged with an opposite polarity so that an electrical field which penetrates the piezoelectric layer 2 is produced between the electrode layers 3 and 4.

FIG. 1A shows the state of the sound transducer in the case where no voltage is applied. The carrier layer 1, the piezoelectric layer 2 and the electrode layers 3 and 4 hereby extend in one plane, i.e. are flat. If now, as shown in FIG. 1B, a voltage is applied between the electrode layers 3 and 4 by means of the voltage source 5, then an electrical field penetrates the piezoelectric layer 2. The piezoelectric layer 2 consequently shortens, as a result of which the entire membrane structure of the carrier layer 1, of the electrode layers 3 and 4 and also of the piezoelectric layer bends upwards in the direction of the piezoelectric layer. If the voltage 5 has its polarity reversed, the piezoelectric layer 2 expands and the membrane structure bends away from the piezoelectric layer 2. If an alternating voltage is applied to the voltage source 5, then the membrane structure can be made to vibrate.

FIG. 2 shows a sound transducer according one or more embodiments of to the invention which has a circular configuration so that it can be placed particularly conveniently in front of the round window of an ear. FIG. 2A thereby shows a plan view on the sound transducer so that one of the electrode layers 4 can be seen, FIG. 2B shows a plan view on a side situated opposite the side shown in FIG. 2A so that the carrier layer 1 can be seen and FIG. 2C shows a plan view which corresponds to the plan view shown in FIG. 2A, the membrane structure being situated however in the deflected state here.

FIGS. 2A and 2B show a sound transducer according to one or more embodiments of the invention having a circular membrane structure in the non-deflected state in which no voltage is applied to the piezoelectric layers 3 and 4. The membrane structure in the illustrated example is subdivided by intersection lines 7 into eight segments 9*a*, 9*b*. The segments 9*a*, 9*b* hereby are configured in the shape of a piece of cake and are connected securely to an edge 6 of the sound transducer. The segments 9*a*, 9*b* are separated from each other mechanically at the intersection lines 7 so that they are mutually moveable here. In a centre 8 of the membrane structure according to the invention, a small opening 8 in which the intersection lines 7 end can be provided. The intersection lines 7 in the illustrated example extend radially from the edge 6 in the direction of the centre 8.

FIG. 2C shows the membrane structure shown in FIGS. 2A and 2B in a state which is set if, as in FIG. 1B, a voltage is applied between the electrode layers 3 and 4. The segments 9*a*, 9*b* of the membrane structure are bent here as bimorph beams in the direction of the electrode layer 4, i.e. upwards in the illustrated example. The spacing of the deflected segments from that plane in which the segments are stationary in the undeflected state increases in the direction of the centre 8 and reaches its greatest value at those ends of the segments 9*a*, 9*b* orientated towards the centre. The curvature of the segments 9*a*, 9*b* thereby maintains its sign between edge 6 and centre 8. If the voltage applied to the electrodes 3 and 4 is reversed in polarity, then the segments 9*a*, 9*b* bend in the direction of the carrier layer 1, i.e. downwards in the example shown in FIG. 2C. By applying an alternating voltage, the segments 9*a*, 9*b* can be made to vibrate. In FIG. 2, the membrane structure is segmented into segments 9*a*, 9*b*. This means that both the carrier layer 1 and the piezoelectric layer 2 and the electrode layers 3 and 4 are segmented into segments 9*a*, 9*b* such that the carrier layer 1, the electrode layers 3 and 4 and the piezoelectric layer 2 of one segment respectively cover each other completely.

FIG. 3 shows two possible embodiments of the sound transducer according to one or more embodiments of the invention for comparison. The embodiment shown in FIG. 3A corresponds to that shown in FIGS. 1 and 2 where the membrane structure is subdivided into segments 9*a*, 9*b*. In that embodiment shown in FIG. 3B, in contrast an unsegmented membrane structure is present. The segmented embodiment shown in FIG. 3A hereby permits greater deflection relative to the unstructured membrane shown in FIG. 3B since the two elements 9*a*, 9*b* in the centre 8 of the circular membrane can deform freely and therefore experience a constant curvature in only one direction, in the direction from the edge 6 to the centre 8. In the case of the unsegmented membrane shown in FIG. 3B, the deflection is smaller in the centre 8. Furthermore, the curvature of the membrane changes from the edge 6 in the direction of the centre 8 and changes its sign. On the other hand, FIG. 3B facilitates a gas- and liquid-impermeable sealing of an opening through the sound transducer according to the invention.

FIG. 4 shows a section through a sound transducer according to one or more embodiments of the invention, in which a piezoelectric layer 2 is disposed between an electrode layer 3 and an electrode layer 4. The embodiment corresponds essentially to that shown in FIG. 1. By means of a voltage source 5, a voltage can be applied between the electrode layers 3 and 4, which causes an electrical field 10 to penetrate the piezoelectric layer 2, as can be detected in the enlargement. The electrical field 10 has the effect that the piezoelectric layer 2 expands or contracts, as a result of which the membrane structure with the carrier layer 1, the electrode layers 3 and 4 and the piezoelectric layer 2 bends. If an alternating voltage is applied at the voltage source 5, then the membrane structure can be made to vibrate.

FIG. 5 shows a further embodiment of the present invention in which a large number of piezoelectric layers 2*a*, 2*b*, 2*c*, 2*d* with electrode layers 3, 4 disposed between them is disposed now on a carrier layer 1. Firstly an electrode layer 4 is thereby disposed on the carrier layer 1, on which electrode layer a piezoelectric layer 2*a* is then disposed. On the piezoelectric layer 2*a*, an electrode layer with a negative polarity 3 relative to the polarity of the above-mentioned electrode layer is then disposed. A further piezoelectric layer 2*b* is now disposed on this electrode layer 3, on which piezoelectric layer in turn an electrode layer with opposite polarity relative to the electrode layer 3 is disposed. In the illustrated example, in total four piezoelectric layers and three electrode layers 4 of the one polarity and also two electrode layers 3 of the opposite polarity alternate. Between respectively two adjacent electrode layers 3, 4 an electrical field 10 is formed, which penetrates between the piezoelectric layer 2*a*, 2*b*, 2*c*, 2*d* which is situated between the electrode layers 3, 4 so that said piezoelectric layer expands or contracts. The direction of the electrical field thereby alternates corresponding to the alternating polarity of the electrode layers for the adjacently situated piezoelectric layers 2*a*, 2*b*, 2*c*, 2*d*. In turn, by applying an alternating voltage to the voltage source 5 between the electrode layers 3 and the electrode layers 4, the entire membrane system with carrier layer 1 and also all the piezoelectric layers 2 and electrode layers 3 and 4 can be made to vibrate.

FIG. 6 shows a further embodiment of the present invention. A piezoelectric layer 2 which directly contacts the carrier layer 1 in the illustrated example is hereby disposed on a carrier layer 1. On that side of the piezoelectric layer 2 orientated away from the carrier layer 1, now strip-shaped electrodes 3, 4 with alternating polarity are disposed adjacently and parallel to each other. On the surface of the piezoelectric layer 2 orientated away from the carrier layer 1 electrodes of the one polarity 3, in the sectional illustration, alternate therefore with the electrodes of the other polarity 4. In the sectional illustration in FIG. 6, the strip-shaped electrodes 3 and 4 are also shown in section and have here an essentially rectangular cross-section. The electrodes 3 and 4 are situated equidistantly from each other.

Between respectively two adjacent electrodes 3 and 4, an electrical field 10 which extends from one of the electrodes 3 through the piezoelectric layer 2 to the adjacent electrode of opposite polarity 4 is now formed. The electrical field 10 which is produced by applying a voltage to the voltage source 5 between the electrodes 3 and 4 therefore penetrates the piezoelectric layer 2. This consequently changes its length so that the membrane structure with the carrier layer 1 and the piezoelectric layer 2 bends upwards or downwards. As also in the preceding examples, the membrane structure can be carried by a frame 6 and be segmented or continuous.

FIG. 7 shows a further embodiment of the present invention in which in turn a piezoelectric layer 2 is disposed on a carrier layer 1. The piezoelectric layer 2 is again disposed directly on the carrier layer 1. Electrodes 3 and 4 which can be supplied with different polarity by applying a voltage are also provided in this embodiment. Here also, the electrodes have a strip-shaped configuration and extend in the longitudinal direction parallel to each other and parallel to the surface of the carrier layer 1 on the piezoelectric layer 2. In the example illustrated in FIG. 7, the electrodes 3 and 4 however do not extend on the surface of the piezoelectric layer 2, as shown in FIG. 6, but penetrate the piezoelectric layer 2 in two planes. In each of the planes, analogously to on the surface of FIG. 6, electrodes 3 and 4 with alternating polarity extend adjacently parallel to each other. Therefore, an electrode 3 of the one polarity alternates with an electrode 4 of the other polarity in one plane respectively. As a result, when applying a voltage to the voltage source 5, electrical fields 10 which extend between the electrodes 3 and 4 and penetrate the piezoelectric layer 2 are produced. In the illustrated example, the electrodes of the two illustrated planes extend one above the other so that an electrode of the upper plane always extends above an electrode of the lower plane. The electrodes which extend one above the other here have the same polarity so that the electrical fields are formed principally between the electrodes of one plane. However, it would also be conceivable that the strip-shaped electrodes 3 and 4 are disposed such that electrodes extending one above the other always have a different polarity. The polarities can nevertheless alternate within one plane.

By applying a voltage source 5, the piezoelectric layer 2 can therefore be penetrated by an electrical field 10, which leads to expansion or shrinkage of the piezoelectric layer 2. This in turn results in the membrane system with the carrier layer 1 and the piezoelectric layer 2 bending. Applying an alternating voltage here also produces vibration of the membrane system.

FIG. 8 shows a plan view on a sound transducer according to one or more embodiments of the invention in which the electrodes are disposed as in FIG. 6 or FIG. 7. In the embodiment of FIG. 6, the electrodes extend on the illustrated surface. If the embodiment is that of FIG. 7, further electrodes 3 and 4 are disposed inside the piezoelectric layer below the illustrated electrodes 3 and 4. The electrodes 3 and 4 then penetrate the piezoelectric layer 2 in one or more planes.

The membrane shown in FIG. 8 is in turn circular and the electrodes are configured as concentric segments. A large number of electrodes 3 and 4 extend in a circle about the centre 8 of the membrane, the polarity of the electrodes 3 and 4 alternating from the edge 6 in the direction of the centre 8. The membrane shown in FIG. 8A is segmented into eight segments 9*a*, 9*b* which are disposed securely on a common edge 6 and are decoupled mechanically from each other.

The large number of electrodes 3 and 4 in the example shown in FIG. 8A are contacted by conductors 11 and 12 which extend radially from the edge 6 in the direction of the centre 8. Electrodes of one polarity 3 thereby are always contacted by one conductor 11 and electrodes of the other polarity 4 by another conductor 12. Therefore, a large number of electrodes 3 of the same polarity can always be contacted by a common conductor 11.

FIG. 8B shows a segment 9*a* in detail. It can be detected that the electrodes of the one polarity 4 and those of the other polarity 3 engage one in the other in the shape of a comb and are contacted in common at their one end by a common conductor 11 or 12. The electrodes of one polarity 4 hereby extend from their common conductor 12 in the direction of the conductor 11 of the other polarity, but end before they reach the latter so that no electrical contact between electrodes 4 of one polarity and a conductor 11 of the other polarity comes to exist. In the large part of the region between two conductors 11 and 12 of a different polarity, electrodes 3 and 4 always extend alternately in the radial direction so that electrical fields can be formed, as described above, between the electrodes, which electrical fields penetrate the piezoelectric layer and consequently can effect expansion or contraction of the piezoelectric layer 2.

FIG. 9 shows a possible arrangement of a sound transducer 91 according to one or more embodiments of the invention in an ear. The sound transducer 91 has a basic body 92 on which the membrane is disposed over an edge 6, only the carrier layer 1 of which is shown here. By means of a cable 93, the sound transducer 91 can be supplied with electrical energy from outside the ear or from the middle ear. In the illustrated example, the sound transducer 91 is disposed in the round window 94 and in fact directly on the round window membrane 95. It would also be conceivable to dispose the sound transducer in front of the oval window, in front of which the stirrup 91 can be seen here. The illustrated arrangement in front of the round window is particularly favourable since here the sound transducer 91 can be inserted by a doctor in a relative simple manner through the outer ear and the eardrum.

If in the illustrated example the membrane system is made to vibrate, then the vibration is transmitted directly to the round window membrane 95, as a result of which sound waves can be produced in the inner ear 96. Other possibilities for the arrangement of a sound transducer 91 would exist in other locations in the ear, for example in front of the eardrum, similarly to in front of the round window membrane in the illustrated example or as earphone in front of the outer auditory canal. In particular in the external auditory canal, the sound transducer 91 could also serve as microphone. The illustrated sound transducer 91 can however also be coupled to any other sound sensors which enable actuation of its membrane structure. The sound transducer can also be used in the external auditory canal as earphone. The external shape of sound transducer 91 and membrane structure must hereby be adapted to the anatomical surroundings.

FIG. 10 shows a sound transducer having six sound transducers 102*a*, 102*b*, 102*c*, 102*d*, 102*e*, 102*f* which are disposed one above the other in order to achieve a high amplitude and correspond respectively to those sound transducers shown in FIG. 3A. The same reference numbers hereby correspond to the reference numbers used in FIG. 3A. Respectively two adjacent membrane structures, e.g. 102*a* and 102*b* or 102*b* and 102*c*, are hereby disposed mutually reversed so that the membrane structures, when applying the same polarity for adjacent membrane structures, deflect in the opposite direction. If therefore an electrode 3 of a given polarity is orientated downwards in the case of one sound transducer 102*c*, then it is orientated upwards in the case of the adjacent sound transducers 102*b* and 102*d*. Correspondingly, the electrode 4 of another polarity which is orientated upwards in the case of one sound transducer 102*c* is orientated downwards in the case of the adjacent sound transducers 102*b* and 102*d*. The individual segments of adjacent sound transducers are respectively connected to each other via connection means 101 so that a movement of a segment of a sound transducer effects a movement of the same segment of an adjacent sound transducer. The segments of one sound transducer are hereby connected only to the segments of a further adjacent sound transducer, namely of that sound transducer towards which the membrane structure is orientated. Only one of the membrane structures, preferably an outer membrane structure 102*a* or 102*f*, is implanted securely in the sound transducer with respect to one ear. The other membrane structures 102*b*, 102*c*, 102*d*, 102*e* are moveable and are moved if the segments bend. With the construction shown in FIG. 10, deflections of the sound transducer can be produced with a particularly high amplitude.

FIG. 11 shows a further construction of a sound transducer with a plurality, four here, of membrane structures 202*a*, 202*b*, 202*c* and 202*d*, as are shown in FIG. 3A. The membrane structures are hereby disposed again one above the other parallel to each other and have the same orientation in this example. This means that all the electrodes of one polarity are disposed on one side, for example the upper side of the corresponding sound transducer, and all the electrodes of the other polarity 3 on the opposite side, for example the underside of the carrier layer 1. If therefore a voltage of a specific polarity is applied to all the membrane structures, then the membrane structures all deflect in the same direction. In the illustrated example, the membrane structures are deflected temporarily upwards. Adjacent membrane structures are connected to each other via connections means 201, all the membrane structures here being connected to each other. A membrane structure 202*b* is therefore connected to both adjacent membrane structures 202*a* and 202*c*. The connection hereby has the effect that a force effect of a deflection of one membrane structure is transmitted to the adjacent membrane structures. Preferably, all the membrane structures 202*a*, 202*b*, 202*c*, 202*d* are fixed here with respect to an ear in which they are incorporated so that the segments move relative to the ear. A vibration with a particularly high force effect can be achieved by the illustrated embodiment.

What is claimed is:

1. A sound transducer for insertion in an ear, with which sound vibrations can be produced, comprising:

at least one membrane structure, the membrane structure having at least one carrier layer and at least one piezoelectric layer which has a piezoelectric material and is disposed on the carrier layer so that, by applying a voltage to the piezoelectric layer, vibrations of the membrane structure can be produced, the membrane structure being subdivided into at least two or more segments in a surface of the membrane structure by at least one intersection line separating all the layers of the membrane structure so that the membrane structure is mechanically decoupled at the intersection line so that the at least two segments which are separated by the intersection line are movable independently of each other, wherein the membrane structure is circular, elliptical or n-cornered, with n≥8, and the at least one intersection line extends radially from one edge of the membrane structure in a direction of a centre of the membrane structure so that at least two segments are formed, which are disposed firmly respectively with a broad edge at the edge of the membrane structure and are moveable with a side orientated towards the centre which is situated opposite the broad edge.

2. The sound transducer according to claim 1, wherein the sound transducer is an implantable sound generator for a hearing aid, with which sound vibrations can be produced by means of the vibrations of the membrane structure, the at least one membrane structure being configured such that it can be disposed in, on or in front of a round window or an oval window of an ear or in a round window niche of an ear, covering the corresponding window at least partially, with a membrane of the corresponding window in direct contact or in contact via connective tissue such that vibrations of the membrane structure effect sound vibrations through the round or oval window.

3. The sound transducer according to claim 1, wherein the membrane structure is circular, elliptical or n-cornered, with n≥8, and at least one of the intersection lines structures the membrane structure in at least one segment of said segments extending spirally around a centre of the membrane structure.

4. The sound transducer according to claim 1, wherein the membrane structure has at least one first and at least one second electrode layer, the at least one piezoelectric layer being disposed between the first and the second electrode layer.

5. The sound transducer according to claim 1, wherein the membrane structure has a plurality of piezoelectric layers disposed one upon the other with parallel surfaces, an electrode layer being disposed between respectively two adjacent piezoelectric layers, respectively two adjacent electrode layers being able to be supplied with a charge of a different polarity so that an electrical field from the one to the other electrode layer is formed between respectively two adjacent electrode layers.

6. The sound transducer according to claim 1, including one or more electrode pairs having respectively at least two strip-shaped electrodes, the strip-shaped electrodes of the electrode pairs respectively being disposed parallel to each other and parallel to a surface of the at least one piezoelectric layer such that respectively of said strip-shaped two electrodes extending adjacently relative to each other can be supplied with a charge of a different polarity so that an electrical field penetrating the piezoelectric layer is formed between respectively two of said strip-shaped electrodes extending adjacently relative to each other, the strip-shaped electrodes of a plurality or all of the electrode pairs extending parallel to each other.

7. The sound transducer according to claim 6, wherein the membrane structure has a circular, elliptical or n-cornered circumference, with n≥8, and the strip-shaped electrodes are formed as concentric segments about a centre of the membrane structure or are formed between respectively two adjacent radial intersection lines straight and tangentially to a circle about the centre of the membrane structure.

8. The sound transducer according to claim 7, wherein the electrode pairs and/or the strip-shaped electrodes are encapsulated in a liquid-impermeable manner or electrically insulated so that they do not come into contact with a liquid surrounding the sound transducer.

9. The sound transducer according to claim 6, wherein electrodes of the same polarity are in contact with respectively at least one common conductor which extends parallel to the surface of the piezoelectric layer, with the conductor extending in thea radial direction.

10. The sound transducer according to claim 6, wherein the electrodes are disposed directly on an upper side of the piezoelectric layer orientated away from the carrier layer.

11. The sound transducer according to claim 6, wherein the membrane structure has a plurality of piezoelectric layers disposed one upon the other, the electrode pairs being disposed in one or more planes between respectively two adjacent piezoelectric layers, the electrode pairs penetrating the piezoelectric layer in one or in at least two planes parallel to the piezoelectric layer and electrodes of the same electrode pair being disposed in the same plane.

12. The sound transducer according to claim 1, wherein the membrane structure is encapsulated in a liquid-impermeable manner or electrically insulated so that they do not come into contact with a liquid surrounding the sound transducer.

13. The sound transducer according to claim 1, wherein the at least one piezoelectric layer has a thickness of ≤20 μm.

14. The sound transducer according to claim 1, wherein at least two of the membrane structures are structured in the same way and are disposed one above the other parallel to each other such that identical segments are situated one above the other, identical segments of all or respectively two of the adjacent membrane structures being connected respectively to each other such that a deflection or force exertion of the one segment is transmitted to the adjacent segment.

15. The sound transducer according to claim 14, wherein said identical segments of adjacent membrane structures, upon applying a voltage with a given polarity to the sound transducer, are deflected in the same direction or in opposite directions.

16. A method for producing a sound transducer, comprising:

providing at least one membrane structure, the membrane structure having at least one carrier layer and at least one piezoelectric layer which has a piezoelectric material and is disposed on the carrier layer so that, by applying a voltage to the piezoelectric layer, vibrations of the membrane structure can be produced, the membrane structure being subdivided into at least two or more segments in a surface of the membrane structure by at least one intersection line separating all the layers of the membrane structure so that the membrane structure is mechanically decoupled at the intersection line so that the at least two segments which are separated by the intersection line are movable independently of each other, wherein the at least one piezoelectric layer is produced by deposition of piezoelectric material at a thickness of the piezoelectric layer, wherein the membrane structure is circular, elliptical or n-cornered, with n≥8, and the at least one intersection line extends radially from one edge of the membrane structure in a direction of a centre of the membrane structure so that at least two segments are formed, which are disposed firmly respectively with a broad edge at the edge of the membrane structure and are moveable with a side orientated towards the centre which is situated opposite the broad edge.

17. The method of claim 16, wherein the at least one piezoelectric layer has a thickness of ≤20 μm.

18. The method of claim 16, wherein the at least one piezoelectric layer has a thickness of ≤10 μm.

19. The method of claim 16, wherein the at least one piezoelectric layer has a thickness of ≤5 μm.

20. The method of claim 16, wherein at least one of said piezoelectric layer has a thickness of ≥0.2 μm.

21. The sound transducer of claim 1, wherein regions of the membrane structure which are separated by the intersection line are movable independent from each other.

22. The method of claim 16, wherein regions of the membrane structure which are separated by the intersection line are movable independent from each other.

* * * * *